United States Patent [19]

Olson

[11] 4,393,915

[45] Jul. 19, 1983

[54] WEB SECURING DEVICE

[76] Inventor: Carl G. Olson, 705 N. Elmhurst Rd., Prospect Heights, Ill. 60070

[21] Appl. No.: 133,346

[22] Filed: Mar. 24, 1980

[51] Int. Cl.[3] ..... A47H 13/00; A47H 23/01

[52] U.S. Cl. ..... 160/395; 160/384

[58] Field of Search ..... 160/273 R, 273 C, 392–396, 160/384, 290 R, 397, 399, 401, 403, 24, 27, 373, 484, 391; 16/DIG. 18, DIG. 24, DIG. 25, 114 R; 40/904; D8/321; 350/117

[56] References Cited

U.S. PATENT DOCUMENTS

| | | | |
|---|---|---|---|
| 296,649 | 3/1884 | Tripp | 160/393 |
| 536,517 | 3/1895 | Hahn | 160/273 R |
| 1,079,431 | 11/1913 | Nitka | 160/394 X |
| 1,138,668 | 5/1915 | Knapp | 160/273 C |
| 2,766,814 | 10/1956 | Sedlacek | 160/395 X |
| 3,379,237 | 4/1968 | Worthington | 160/391 X |
| 3,524,491 | 8/1970 | Olson | 160/393 |
| 4,071,063 | 1/1978 | Russell | 16/114 R |
| 4,279,061 | 7/1981 | Santo | 160/391 X |

*Primary Examiner*—Peter M. Caun
*Assistant Examiner*—Cherney S. Lieberman
*Attorney, Agent, or Firm*—Trexler, Bushnell & Wolters, Ltd.

[57] ABSTRACT

There is disclosed a device for attachment to a free margin of flexible webbing material, as for example, a map, wherein the device comprises an elongated mounting strip to which the free margin of flexible webbing material may be affixed and a rigid elongated substantially hollow holder element having an open end, an outer wall, and a longitudinal slot within the outer wall having a width approximating the thickness of the webbing material. The outer wall is continuous in cross-section circumferentially from one edge of the slot to the other edge of the slot. The holder element further includes elongated rib means within the holder element extending substantially the entire length thereof. The rib means defines an aperture communicating with the slot and is shaped to accommodate the mounting strip lengthwise through the open end with the webbing material extending through the slot. The aperture has inner walls formed by the rib means arranged to coact with the mounting strip to facilitate impingement of the mounting strip with the aperture inner walls as an incident to the lateral shifting of the holder element. The disclosed device further includes a handle means adapted to be affixed to the holder element including a fastener portion adapted to lockingly engage the holder element and a pendant loop shaped member pivotally carried by the fastener portion at a pivot point. The fastener portion is positionable upon the holder element to allow the loop member to extend downwardly from behind or in front of the holder element or any point therebetween without obstructing the longitudinal slot.

5 Claims, 7 Drawing Figures

WEB SECURING DEVICE

BACKGROUND OF THE INVENTION

The present invention relates generally to apparatus for securing flexible webbing and more particularly to a new and improved edge securing device for flexible webbing, such as, for example, pull-down window shades, maps, or the like.

In the past, window shades, maps, charts, etc., and other forms of flexible webbing, have included, along the free edge thereof, a section of the webbing which has been folded back upon itself and secured thereat either by sewing or other suitable means to form a looped "pocket" or the like. An elongated strip of wood was usually inserted into and held in the "pocket" and served as a "pull" for the window shade or map.

While the foregoing was generally satisfactory, an added cost was required to form this looped section or pocket at the free edge of the shade or map and a significant additional quantity of material was also required to make such a pocket. Moreover, if the pocket became ripped or torn, the shade or map had to, in most cases, be taken to a professional for repairs. This, too, required added expense.

As an improvement to such structures, a device was devised for attachment to a free margin of a piece of flexible webbing material which included an elongated mounting strip to which an end of the webbing material was attached, and an elongated open-ended holder element. The holder element had a longitudinally extending aperture therethrough having a shape of an hourglass in cross-section and a longitudinally extending slot opening laterally of the holder element and communicating with the aperture.

The mounting strip was insertable into one end of the aperture in the holder element with the webbing material extending outwardly therefrom through the slot to thereby secure the end of the material in the holder element. Tension applied to the material away from the holder element caused the mounting strip to be rotated within the aperture about the constricted section thereof and to be interlocked against opposite walls and in a corner thereof. Such a device is shown and described, for example, in U.S. Pat. No. 3,524,491 which issued on Aug. 18, 1970, in the name of the inventor of the present invention.

While this later device did exhibit a distinct improvement over the web securing devices which came before, there remained room for improvement. For example, the holder element of the last mentioned device was found not to be rigid enough to accommodate window shades, maps, or charts of broad width. In such applications, it was found that the holder element would bow downwardly at its center. Such bowing was also pronounced when the holder element was pulled downwardly.

There are also many applications when maps, charts, or the like are grouped together when hung horizontally so as to conserve wall space. Prior art devices have failed to provide a convenient handle means whereby a selected one of the charts or maps may be pulled down into view by the use of a hook rod or the like.

It is therefore a general object of the present invention to provide a new and improved web securing device for flexible webbing such as, for example, pull-down window shades, maps, or the like.

It is a further object of the present invention to provide such a web securing device which includes a rigid holder element to preclude bowing of the device when used in conjunction with window shades, maps, or charts of considerable width.

It is a more particular object of the present invention to provide such a web securing device wherein the rigid holder element is also light in weight.

It is a further object of the present invention to provide a new and improved web securing device which includes a novel handle means having a looped pendant member to facilitate the grasping of the holder element with a hook rod or the like and wherein the handle means includes a fastener portion adapted to lockingly engage the holder element and positionable thereon to allow the looped member to extend downwardly from behind or in front of the holder element or any point therebetween so as to enable ready selection of a given map or chart which is mounted in clustered relation with other such maps or charts.

SUMMARY OF THE INVENTION

The invention therefore provides a device for attachment to a free margin of flexible webbing material, as for example, a map. The device includes an elongated mounting strip to which the free margin of flexible material may be affixed, and a rigid elongated substantially hollow holder element having an open end, an outer wall, and a longitudinal slot within the outer wall having a width approximating the thickness of the webbing material. The outer wall is continuous in cross-section circumferentially from one edge of the slot to the other edge of the slot. The holder element further includes elongated rib means within the holder element extending substantially the entire length thereof. The rib means defines an aperture communicating with the slot and is shaped to accommodate the mounting strip lengthwise through the open end with the webbing material extending through the slot. The aperture has inner walls formed by the rib means arranged to coact with the mounting strip to facilitate impingement of the mounting strip with the aperture inner walls as an incident to the lateral shifting of the holder element.

The invention also provides a device for attachment to a free margin of flexible webbing material, as for example, a pull-down map. The device includes elongated holder means having a longitudinal slot for lockingly receiving the free margin of the flexible webbing material and handle means adapted to be affixed to the holder means to facilitate the lateral pulling of the holder means and the web material. The handle means includes a fastener portion adapted to be received by the holder means and a pendant looped shaped member pivotally carried by the fastener portion at a pivot point. The fastener portion is positionable upon the holder means to allow the looped member to extend downwardly from behind or in front of the holder means or any point therebetween without obstructing the longitudinal slot.

BRIEF DESCRIPTION OF THE DRAWINGS

The features of the present invention which are believed to be novel are set forth with particularly in the appended claims. The invention, together with further objects and advantages thereof, may best be understood by making reference to the following description taken in conjunction with the accompanying drawings, in the several figures of which like reference characters identify identical elements, and wherein:

DESCRIPTION OF THE PREFERRED EMBODIMENT

Figure 1:
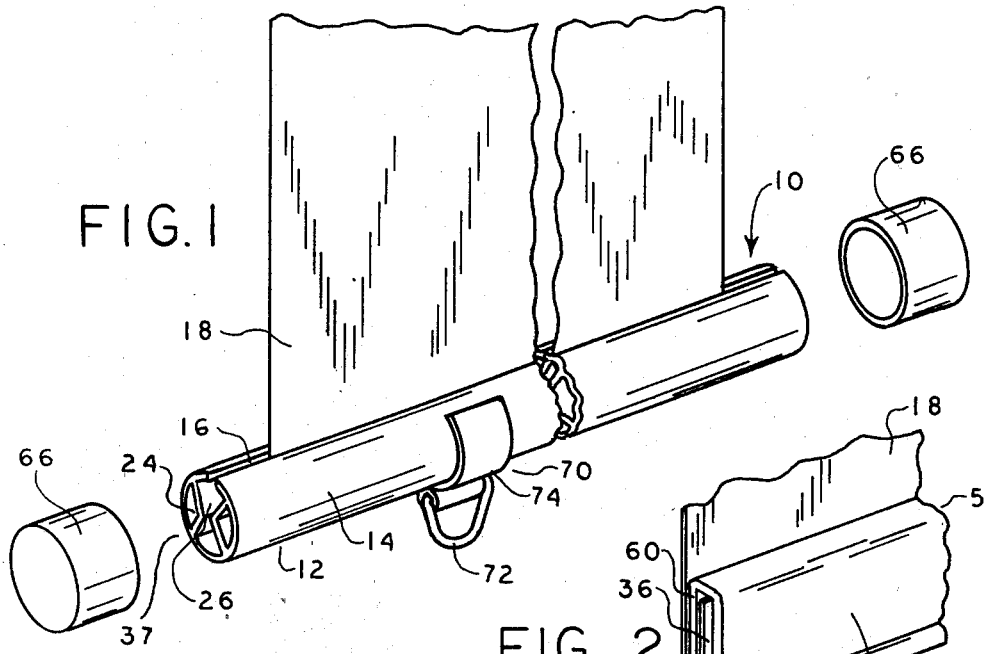
FIG. 1 is an exploded perspective view of an improved web securing device embodying the present invention.

Referring now to FIG. 1, there is shown a web securing device 10 according to the present invention. The device comprises a rigid, elongated and substantially hollow housing or holder element 12, formed of plastic, or other suitable material. When formed of plastic, the holder is constructed preferably by an extruding process to ensure the uniform length thereof.

Figure 3:
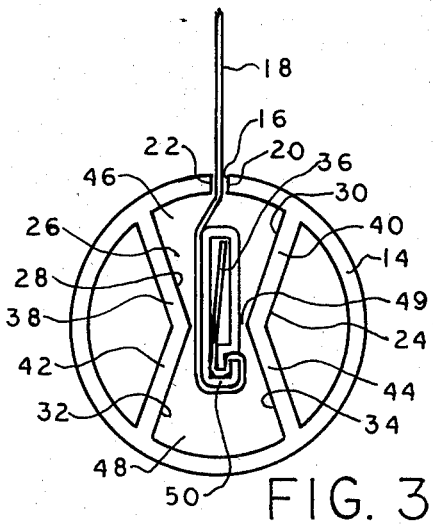
FIG. 3 is an end view of a web securing device according to the present invention immediately after the mounting strip with web material attached thereto has been inserted into the holder element thereof.

The holder element 12, as may be best noted in FIG. 3, includes an outer wall 14 and a longitudinal slot 16 within the outer wall having a width approximating the thickness of the webbing material 18. The outer wall as may be best noted in FIG. 3 is continuous in cross-section circumferentially from one edge 20 of the slot to the other edge 22 of the slot. Preferably, as shown, the holder element 12 is cylindrical in shape.

The holder element 12 further includes elongated rib means 24 which extend substantially the entire length thereof. The rib means 24 defines an aperture 26 which communicates with the longitudinal slot 16. The aperture 26 includes a plurality of inner walls 28, 30, 32, and 34. The aperture 26 longitudinally extends or runs the length of the holder element 12 and is open at least at one end 37 thereof. In most cases, both ends of the holder are open, since the holder element is cut usually from a long section of holder material to provide the proper length for the webbing in a particular situation. A cross-section of the aperture 26 defined by the inner wall surfaces 28, 30, 32, and 34 of rib means 24 takes the shape of a "hourglass" or "bow tie" shape. This shape results due to the fact that the rib means 24 includes a pair of upper, and inwardly facing walls 38 and 40 which include inner surfaces 28 and 30 respectively, and a pair of lower, inwardly facing walls 42 and 44 which include inner surfaces 32 and 34 respectively. As a result, a pair of truncated, triangularly cross-sectional shaped openings 46 and 48 are defined which are joined at the truncated ends thereof to provide a constricted section 49 at their juncture.

The web securing device 10 further includes a separate mounting strip 50 to which an end portion 36 of the webbing material 18 is attached. To this end, it may be best noted in FIG. 2 that the mounting strip 50 is generally rectangular in cross-section and includes a sidewall 52 which is slotted along its length closely adjacent a bottom wall 54 to form a latch means 55 for receiving the end 36 of the webbing material 18. The sidewall includes a lower lip portion 56 arranged to snap lock behind a wall portion 58 to securely engage the web material 18 and to securely hold the web material 18 within the mounting strip 50.

The strip 50 is of a height slightly less than the height of the hourglass shaped aperture 26. This ensures proper locking of the strip 50 within the aperture, as will be explained in greater detail hereinafter.

In use of the strip 50, the end 36 of the webbing material 18 is inserted into the slot between the wall portions 52 and 58. Thereafter, the wall portion 52 is bent or folded back so as to cause the lip portion 56 to snap into the position illustrated in FIG. 2 so that the material 18 is securely held between the lip portion 56 and the wall portion 58. Thereafter, the material is creased along an edge 59 and the strip 50 is rotated one-half turn so that the material 18 is adjacent the sidewall 60 opposite the wall 52.

Figure 2:
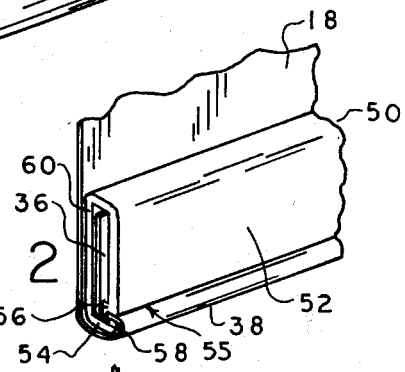
FIG. 2 is a partial perspective view of a mounting strip of a web securing device according to the present invention shown after the sheet of material has been inserted and attached thereto in preparation for insertion thereof into a holder of a web securing device according to the present invention.

When it is desired to provide a web securing device 10 according to the invention on a free edge of a piece or sheet of webbing material, such as material 18, the material is inserted into the mounting strip 50 as described above. After the material is prepared on the strip 50 as illustrated in FIG. 2, the strip with the material thereon is inserted into the aperture 26 of the holder 12 from one end thereof. The material, as will be noted in FIG. 3 is received in the slot 16. The spacing between the sidewalls 20 and 22 of the slot is such that the material can easily be passed therethrough, but the mounting strip 50 will not be able to pass therethrough. The slot provides an opening through which the material extends outwardly from the holder 12.

Figure 4:
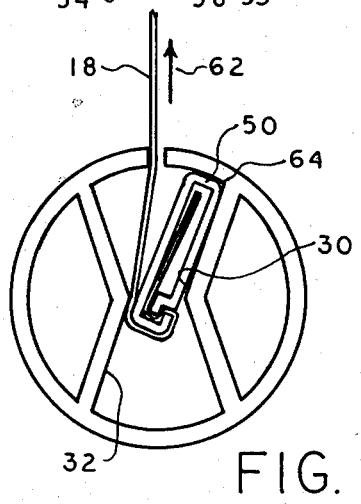
FIG. 4 is an end view of a device of FIG. 6 after the material has been pulled away from the device, illustrating the locking of the strip and web material in the holder element.

As explained above, the height of the mounting strip 50 is less than the height of the aperture 26 so that the strip plus material is easily inserted into the aperture. The insertion of the mounting strip into the aperture 14 places it in constricted section 49 between the juncture of the apertures 46 and 48. When the material 18 is pulled outwardly from the holder in the direction of the arrow 62 (FIG. 4), the strip 50 is caused to be rotated about the constricted area 49 away from the pulled end of the material 18 to interlock and engage the strip against opposite wall surfaces 30 and 32 of the aperture 26 and into a corner 64. As a result, the constricted area 49 serves as a fulcrum means about which the strip 50 rotates to insure locking of the strip 50 against the sidewall surfaces 30 and 32 and into the corner 64 to provide an efficient three-point holding of the material in the holder 12.

Once the strip 50 is confined within the holder 12, a pair of end caps 66 are applied over the open ends of the holder 12. The end caps 66 serve to restrict relative lateral movement of the strip 50 and the holder 12.

By virtue of the fact that the holder 12 is substantially hollow, it is light in weight. However, because the holder 12 includes the internal rib means 24 and includes an outer wall 14 which is circumferentially continuous from one edge 20 of the slot 16 to the other edge 22 of the slot 16, the holder 12 is rigid in structure to preclude sagging thereof in its center portion. Such sagging is prevented notwithstanding the application of the web securing device 10 of the present invention to a map or chart of considerable width dimension.

Figure 5:
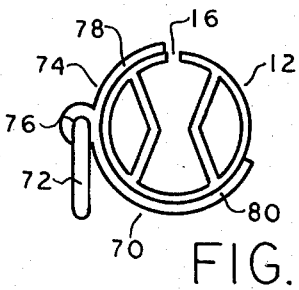
FIGS. 5–7 are end views of the holder element having a novel handle means attached thereto and illustrating the handle means in three different positions thereon in accordance with a particular feature of the present invention to facilitate grasping and pulling of the holder element.
Figure 6:
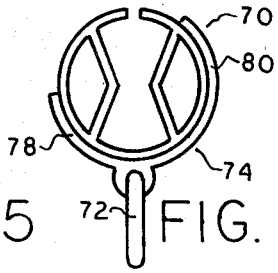
Figure 7:
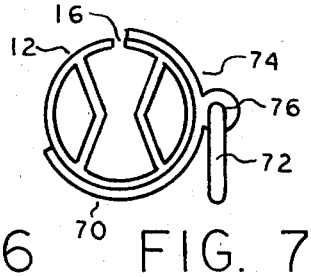

Referring now to FIGS. 5–7, and in accordance with a particular feature of the present invention, the holder 12 includes a handle means 70 which adapts the holder 12 for convenient grasping and lateral pulling. The handle means 70 includes a looped shaped element 72 and a fastener portion 74. The looped shaped member 72 is pivotally carried by the fastener portion 74 at a pivot point 76 so that the looped shaped member 72 is free to extend downwardly therefrom.

The fastener portion 74 is arranged to be lockingly received by the holder element 12. To that end, the fastener portion 74 includes a pair of arcuate extensions 78 and 80 which extend in respective opposite directions from the pivot point 76. The extension 80 as may be best noted in FIGS. 5–7 is greater in arcuate length than the extension 78. More specifically, in accordance with this preferred embodiment, the extension 80 terminates at a point displaced from the pivot point 76 by an angle of approximately 150° while the extension 78 terminates at a point displaced from the pivot point by an angle of approximately 90°. As a result of the foregoing, the fastener portion 74 is positionable upon the holder 12 so that the looped shaped member 72 may depend from the pivot point 76 from either behind the holder element 12 as seen in FIG. 5, from the pivot point 76 in front of the holder element 12 as shown in FIG. 7, or from any point therebetween. As illustrated in FIG. 6, the looped shaped member 72 depends from the holder element 12 from a point immediately below the holder element.

As can be appreciated from FIGS. 5–7, the fastener portion 74 may be applied to the holder element 12 to allow the looped member 72 to depend from the holder element 12 in any position intermediate its position illustrated in FIGS. 5 and 7 without obstructing the longitudinal slot 16. As a result, the loop element 72 may be positioned on the holder element 12 so as to enable convenient grasping of the holder element 12 even when a plurality of charts or maps are clustered together and hung in a horizontal position from, for example, a wall. Preferably, the fastener portion 74 is formed from plastic and is glued to the holder element 12.

From the foregoing, it can be appreciated that the present invention provides a new and improved web securing device. The web securing device of the present invention includes a holder element which is light in weight and rigid so as to avoid sagging thereof when used in conjunction with web material of considerable width. Furthermore, the web securing device of the present invention provides a new and improved handle means which affords convenient grasping and pulling of the holder element even when a plurality of maps or charts are clustered together and hung in a substantially horizontal position on a wall or the like.

While a particular embodiment of the present invention has been shown and described, modifications may be made, and it is therefore intended to cover in the appended claims all such changes and modifications which fall within the true spirit and scope of the invention.

This invention is claimed as follows:

1. A device for attachment to a free margin of flexible webbing material, as for example a map, said device comprising: an elongated mounting strip to which the free margin of flexible webbing material may be affixed; and a rigid, tubular, elongated substantially cylindrical holder element having at least one open end, a cylindrical outer wall, a longitudinal slot within said outer wall having a width approximating the thickness of the webbing material, said outer wall being of predetermined thickness and continuous in cross-section circumferentially from one edge of said slot to the other edge of said slot, to define a cylindrical inner surface coaxial therewith, and a pair of elongated rib means within said holder element and formed integrally therewith, said rib means each being generally V-shaped in cross-section, the legs of each V being symmetrically arranged with respect to said cylindrical inner surface and diverging from diametrically spaced apices to integrally join said cylindrical inner surface and of similar thickness to said outer wall and integrally joining the interior surface of said outer wall at locations spaced apart from said slot and extending substantially the entire length thereof for rigidly supporting said outer wall to resist bending moments while leaving a major portion of the interior portion of the holder element hollow so as to minimize the weight thereof, said rib means further defining an elongated aperture communicating with said slot and being shaped to accommodate said mounting strip lengthwise through said open end with said webbing material extending through said slot, and said aperture having inner walls formed by said rib means arranged to coact with said mounting strip to facilitate impingement of said mounting strip with said aperture inner walls as an incident to the lateral shifting of said holder element; and handle means including an arcuate structure snugly engaging the cylindrical holder element and supported thereby for rotational positioning about said holder element, and being provided with a pendant pull member intermediate longitudinal edges of the arcuate structure with the said edges being selectively spaced from each other a distance permitting the pull member to be positioned in accordance with the rotational positioning of the arcuate structure behind or in front of the holder element or any point therebetween without obstructing the longitudinal slot through which the webbing material extends.

2. A device as defined in claim 1 wherein said holder element comprises a one-piece extruded plastic structure.

3. A device as defined in claim 1 wherein said mounting strip is internally hollow and substantially rectangular in transverse cross-sectional dimension and includes top and bottom walls and opposing sidewalls of greater length in transverse cross-section than the top and bottom walls, one of said sidewalls being slotted along its length closely adjacent said bottom wall and including a lip portion formed to one side of said slot arranged to snap lock behind a portion thereof to the other side of said slot to lockingly receive the free margin of the flexible webbing material therein.

4. A device as defined in claim 1 wherein said holder element outer wall has a predetermined diameter and wherein said arcuate structure comprises a partial ring structure with a pivot joint for said pendant pull member and having a pair of arcuate extensions defining arcs of similar diameter to said predetermined diameter extending in respective opposite directions from said pivot point, and wherein one of said extensions has an arcuate length which is greater than the arcuate length of said other extension.

5. A device as defined in claim 4 wherein said one extension terminates at a point displaced from said pivot point by an angle of approximately 150° and wherein said other extension terminates at a point displaced from said pivot point by an angle of approximately 90°.

* * * * *